US005822888A

United States Patent [19]

Terry

[11] Patent Number: 5,822,888

[45] Date of Patent: Oct. 20, 1998

[54] REVERSABLE SHOE WITH REMOVABLE MIDSOLE

[76] Inventor: Michael R. Terry, 1312 Graceland Av., Racine, Wis. 53403

[21] Appl. No.: 869,315

[22] Filed: Jun. 5, 1997

Related U.S. Application Data

[63] Continuation of Ser. No. 584,979, Jan. 11, 1996, abandoned.

[51] Int. Cl.[6] ..... A43B 3/24

[52] U.S. Cl. ..... 36/100; 36/77 R; 36/69

[58] Field of Search ..... 36/15, 100, 101, 36/77 R, 92, 69

[56] References Cited

U.S. PATENT DOCUMENTS

| | | | |
|---|---|---|---|
| D. 322,001 | 12/1991 | Bayer . | |
| 2,261,125 | 11/1941 | McFeely | 36/101 |
| 2,409,813 | 10/1946 | Timson | 36/100 |
| 3,538,628 | 11/1970 | Einstein, Jr. | 36/15 |
| 3,566,486 | 3/1971 | Conway . | |
| 4,114,295 | 9/1978 | Schaefer . | |
| 4,246,707 | 1/1981 | Pedersen | 36/100 |
| 4,279,083 | 7/1981 | Dilig | 36/101 |
| 4,317,293 | 3/1982 | Goodyear . | |
| 4,373,275 | 2/1983 | Lydiard | 36/54 |
| 4,706,316 | 11/1987 | Tanzi | 36/77 R |
| 4,727,661 | 3/1988 | Kuhn | 36/100 |
| 4,887,369 | 12/1989 | Bailey et al. | 36/101 |
| 5,353,522 | 10/1994 | Wagner . | |
| 5,365,677 | 11/1994 | Dalhgren | 36/54 |
| 5,381,610 | 1/1995 | Hanson | 36/100 |

FOREIGN PATENT DOCUMENTS

| | | | |
|---|---|---|---|
| 1389653 | 1/1964 | France | 36/100 |

*Primary Examiner*—M. D. Patterson
*Attorney, Agent, or Firm*—Godfrey & Kahn,

[57] ABSTRACT

A reversible shoe is comprised of a rubber, double-sided, grooved base with reversible uppers attached between sections of the base. The rear unzips and a midsole insert can be taken from the pegholes in the aforementioned base. The base is turned over and the insert from both shoes are then put on what was the bottom of it's mate. They're then rezipped and relaced to show a different color or design on the uppers, and a fresh tread on the base.

25 Claims, 3 Drawing Sheets

FIG. 6
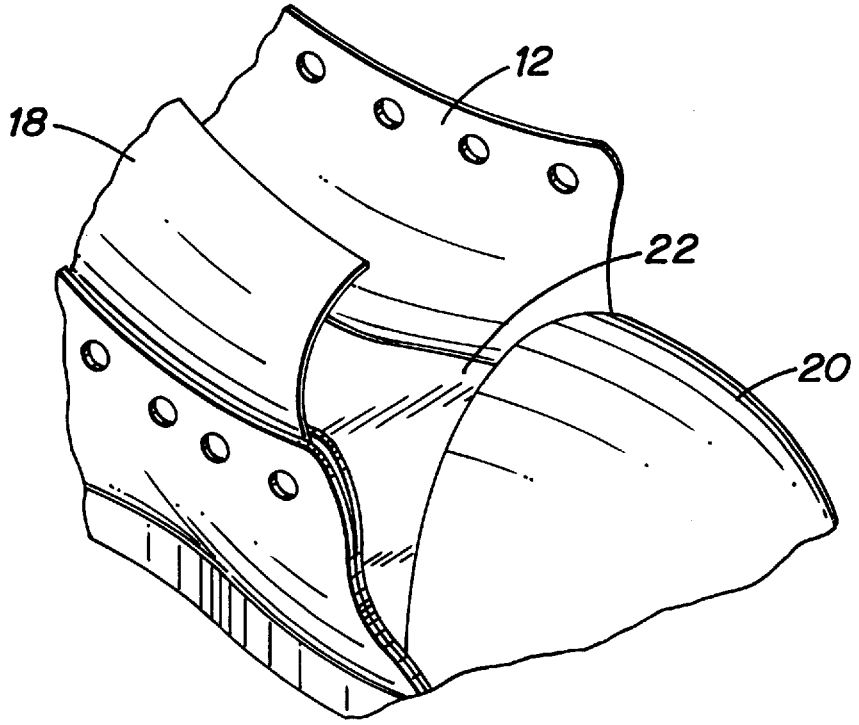
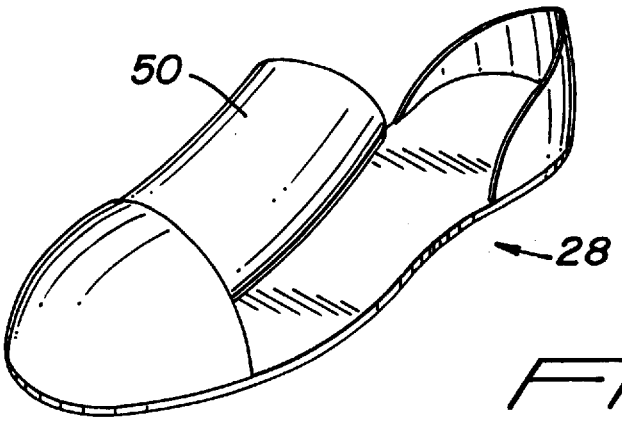
FIG. 7

REVERSABLE SHOE WITH REMOVABLE MIDSOLE

The present application is a continuation of Ser. No. 08/584,979, filed Jan. 11, 1996, now abandoned.

BACKGROUND—FIELD OF INVENTION

The present invention relates to athletic shoes, specifically to a reversible shoe having a removable midsole.

BACKGROUND—DESCRIPTION OF PRIOR ART

This invention solves the problem of purchasing multiple pairs of shoes in order to have a variety of different styles by, itself being two pairs in one. It also solves the problem of excessive wear on the shoe sole by having two different grooved sides on the base of the shoe, therefore doubling it's life.

The problem of excessive wear on athletic shoe soles has had attempted solutions in U.S. Pat. No. 4,317,294 to M. V. Goodyear Mar. 2, 1982 and U.S. Pat. No. 4,279,083 to C. W. Dilig Jul. 21, 1981 both of which rely on a replacement sole to be attached to the remainder of the shoe after significant wear to the sole. Although feasible, they never gained commercial success due to the fact that consumers would just as soon as buy another pair instead of buying a replacement sole and replacing it on their old pair. The present invention eliminates this bias by not requiring an additional purchase. The consumer need only to reverse the shoe to have a fresh unused sole at their disposal.

OBJECTS AND ADVANTAGES

Accordingly, several objects and advantages of the present invention are:

(a) One pair would provide the wearer with two different styles by their conversion therefore imparting a substantial savings to the buyer.

(b) Overall sole wear would take twice as long as a regular pair of shoes due to the two grooved sides of the base.

(c) Uppers would also show less wear by being inside the shoe ½ the time.

(d) A two-toned effect could be attained by partial reversal of one or both shoes.

(e) The invention is simple in construction and operation and therefore, inexpensive to manufacture.

(f) The invention needs no replacement parts that could be lost.

(g) Further objects and advantages of my invention will become apparent from a consideration of the drawings and ensuing description.

DRAWING FIGURES

In the drawings, closely related figures have the same number but different alphabetic suffixes.

Figure 4A:
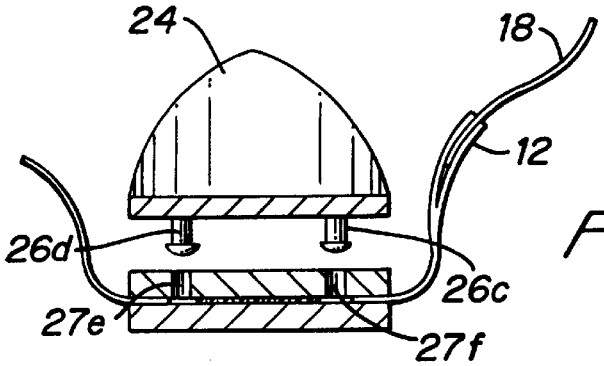

FIG. 4*a* shows a cutaway rear view of the shoe showing the rear midsole attachment means.

Figure 4B:
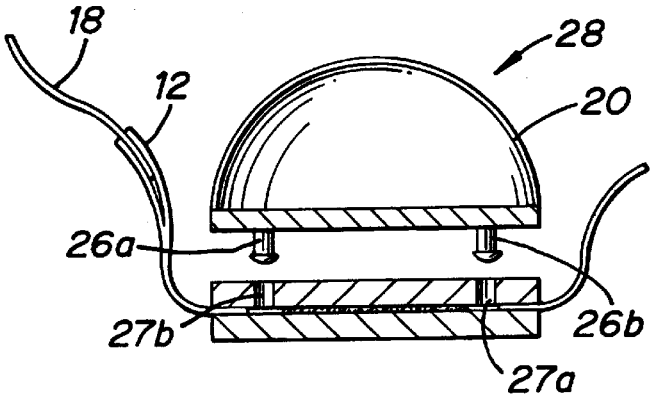

FIG. 4*b* shows a cutaway front view of the shoe showing the front midsole attachment means.

Figure 5A:
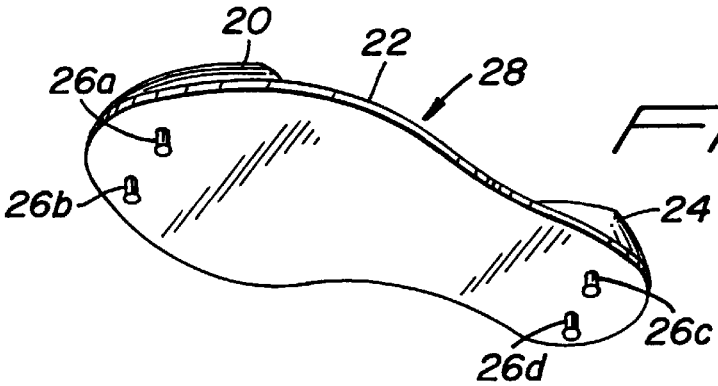
Figure 5B:
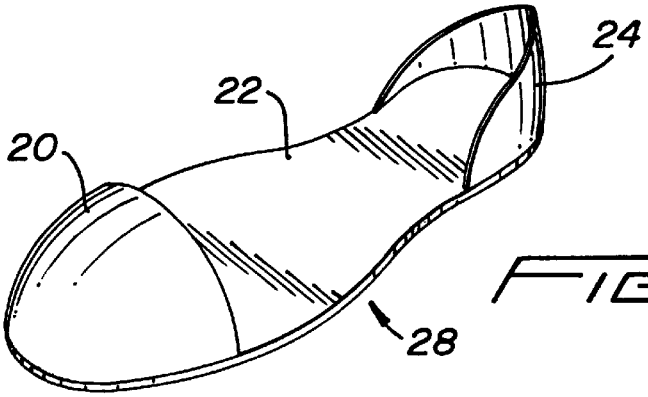

FIG. 5 shows the removed midsole insert, including the attachment means, toe, and heel support.

FIG. 6 shows a top front view exemplifying the preferred tongue placement.

FIG. 7 shows an alternative placement of a tongue on the midsole insert.

REFERENCE NUMERALS IN DRAWINGS

10 Entire shoe
12 Upper
14 Base
16 Zipper
18 Tongue
20 Toe
22 Foot Pad
24 Heel Support
26*a* Peg
26*b* Peg
26*c* Peg
26*d* Peg
27*a* Peg Hole
27*b* Peg Hole
27*c* Peg Hole
27*d* Peg Hole
27*e* Peg Hole
27*f* Peg Hole
27*g* Peg Hole
27*h* Peg Hole
28 Removable Midsole Insert
50 Tongue Description—FIGS. 1 to 6

Figure 1:
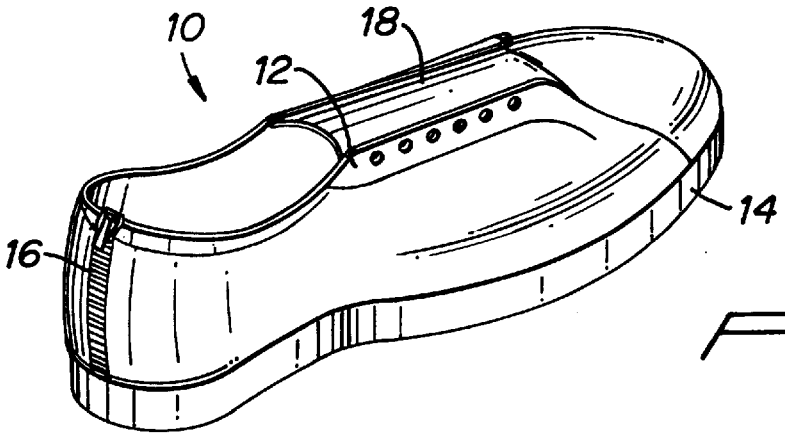
FIG. 1 shows the preferred embodiment of the shoe before the reversing process.
Figure 2:
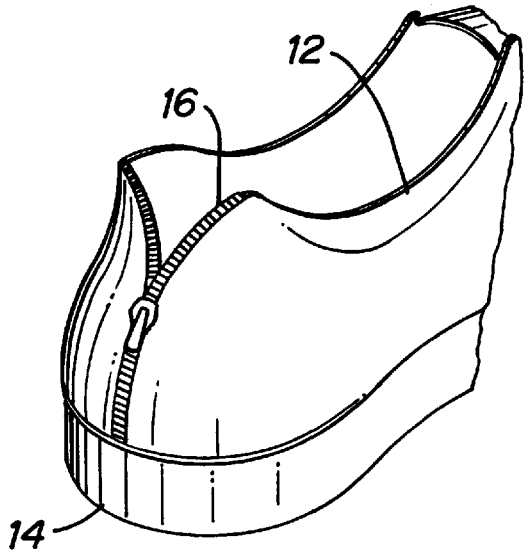
FIG. 2 shows the heel portion with zipper.

A typical embodiment of the present invention, Reversible shoe with removable midsole insert 10 is shown in FIG. 1 (full view) and FIG. 2 (rear view). The shoe has two reversible uppers 12 which are attached to the center of a base 14 for reversibility. In the preferred embodiment the uppers 12 and tongue 18 are closed in the rear by a zipper 16.

Figure 3:
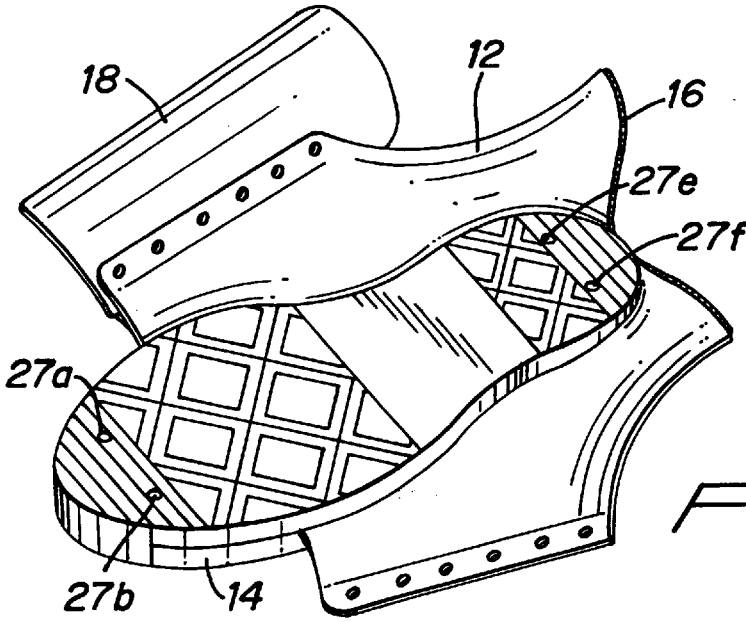
FIG. 3 shows the shoe unzipped and unlaced with the midsole insert removed.

FIG. 3 shows the shoe in the "flat" position with a midsole insert 28 removed. Uppers 12 clearly separated by zipper 16 undone. Tongue 18 is also shown to be attached to one side upper 12. The grooves on base 14 are shown on this side, and are on the reverse side to provide the wearer with traction in either of the shoe's reversible embodiments. Pegholes 27*a*, 27*b*,27*e*,27*f* are also introduced. Their purpose will become evident by reviewing FIGS. 4*a*, 4*b*.

FIGS. 4*a* and 4*b* are cutaway views showing the preferred method of attaching midsole insert 28 into base 14. The view in FIG. 4*a* is a back cutaway, showing a heel support 24, tongue 18, pegs 26*c*–26*d* and their appropriate pegholes 27*e*,27*f*,27*g*,27*h*. Pegholes 27*h* and 27*g* are to be used when the shoe is reversed. FIG. 4*b* is a front cutaway displaying how pegs 26*a*–26*b* go into pegholes 27*a*–27*b*. These front two pegs 26*a*–26*b* being under toe 20. The inverse pegholes 27*c*–27*d* are for use by pegs 26*a*–26*b* also when the shoes are reversed.

FIG. 5 shows a top and bottom view of midsole insert 28 including pegs 26*a*,26*b*,26*c*,26*d* that in the preferred embodiment would be inserted into the appropriate pegholes 27*a*–27*h* on either side of base 14. The entire midsole 28 in this embodiment consists of toe 20 and heel support 24 attached to the top of a foot pad 22 with the aforementioned pegs 26*a*–26*d* attached to the bottom.

A top front view of the unlaced shoe is shown in FIG. 6, this showing the preferred embodiment of tongue 18 sewn between two sections of one side of reversible uppers 12. In alternative embodiments, one of which is shown in FIG. 7, a tongue 50 similar to or identical to the tongue 18 may be attached by other like methods to toe 20, removable midsole 28, or to be removable itself. Toe 20 shown here with foot pad 22 attached to base 14 is also in its preferred embodiment, other embodiments include, but are not limited to, an elastic toe 20 attached to and inverted along with uppers 12.

Operation—FIGS. 2, 3, 4*a*, 4*b*

The manner of using the Reversible shoe with removable midsole insert is the same as any shoe until the wearer wants to invert it to achieve fresh traction on base 14 and, or, another color uppers 12. This is done by unlacing the top, and unzipping zipper 16 (FIG. 2), removing midsole insert 28 by unlatching pegs 26*a*,26*b*,26*c*,26*d* from pegholes 27*a*, 27*b*,27*c*,27*d* or 27*e*,27*f*,27*g*,27*h* as shown in FIGS. 4*a* and 4*b*. The shoe is then laid flat and flipped as in FIG. 3. From there all it needs is its mate's midsole insert pressed into its base 14, and to be relaced and rezipped. Therefore, the wearer always stands on the same midsole insert 28 and bases 14 are undone, inverted and moved to the opposite foot when the reversal process takes place.

Summary, Ramifications, and Scope

Accordingly, the reader will see that the Reversible Shoe with Removable Midsole Insert gives the wearer the option of at least two different styles. (More with the purchase of additional inserts) It would also logically take twice as long to wear out the base, as well as the uppers. And from a manufacturing standpoint could be easily constructed from resources now available making it inexpensive to produce. Furthermore, the reversible shoe has the additional advantages in that All parts are together when the shoe is worn, therefore, there are no "spare parts" to be lost or replaced.

In a high-top embodiment, if partially unzipped, and unlaced, a two-toned effect could be achieved by folding down the high-top.

The top and rear closure means could be in a variety of embodiments such as buttons, hook and loop fasteners, clips, laces, etc. so the buyer could choose their preferential closure devices.

The midsole insert may not need pegs at all if it's bottom is properly grooved to fit into the grooves of the shoe base.

A rear closure device may not be needed at all with the use of elastic material on a part of the shoe for easier inversion.

The shoe could be easily cleaned by machine washing.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

I claim:

1. A reversible shoe comprising:

a removable midsole insert having a toe end with a toe piece for covering the toes of a wearer;

a base having a top side with a means for positioning the midsole thereon, a bottom side with a means for positioning the midsole thereon, a toe end, and a heel end;

first and second uppers secured to said base, said first upper having a first flap and a second flap; and a closure associated with both of said uppers;

a tongue attached to said first upper between the first and second flaps;

wherein the midsole insert is positioned between said uppers.

2. A reversible shoe as claimed in claim 1, further comprising:

a plurality of pegholes in said top side and said bottom side of said base, said plurality of pegholes partially penetrating said base; and a plurality of pegs capable of being inserted in said plurality of pegholes and that project from said midsole insert.

3. A reversible shoe as claimed in claim 2, wherein said plurality of pegholes are located in said toe end and said heel end of said base and wherein said plurality of pegs projecting from said midsole insert project from said toe end and said heel end of said midsole insert.

4. A reversible shoe as claimed in claim 1, wherein said closure comprises hook and loop fasteners attached to said uppers.

5. A reversible shoe as claimed in claim 1, wherein said first and second uppers each have a plurality of eyelets and wherein said closure comprises a shoelace laced through said eyelets.

6. A reversible shoe as claimed in claim 1, wherein said uppers are positioned in said base between said top side and said bottom side.

7. A reversible shoe as claimed in claim 1, wherein said closure comprises a zipper.

8. A reversible shoe as claimed in claim 1, wherein said top side and said bottom side of said base have a tread.

9. A reversible shoe comprising:

a base having a top side, a bottom side, a toe end, and a heel end;

a first upper secured to said base and having a top and a rear;

a second upper secured to said base and having a top and a rear;

a rear closure positioned adjacent the rear of each upper;

a top closure associated with the tops of both of said uppers;

a removable midsole insert positioned between said uppers and removably connected to said base by a means for attaching the midsole insert to the base, said midsole insert having a toe end with a toe piece and a heel end with a heel support; and a tongue attached to said toe piece of said midsole insert.

10. A reversible shoe comprising:

a base having a top side a bottom side, a toe end, and a heel end;

a first upper secured to said base and having a top and a rear;

a second upper secured to said base and having a top and a rear;

a rear closure positioned adjacent the rear of each upper;

a top closure associated with the tops of both of said uppers;

a midsole insert positioned between said uppers and removably connected to said base by a means for attaching the midsole insert to the base, said midsole insert having a toe end with a toe piece and a heel end with a heel support and;

a tongue attached to one of said uppers.

11. A reversible shoe as claimed in claim 9, wherein said means for attaching the midsole insert to the base comprises:

a plurality of pegholes in said top side and said bottom side of said base, said plurality of pegholes partially penetrating said base; and a plurality of pegs capable of being inserted in said plurality of pegholes and projecting from said midsole insert.

12. A reversible shoe as claimed in claim 11, wherein said plurality of pegholes are located in said toe end and said heel end of said base and wherein said plurality of pegs projecting from said midsole insert project from said toe end and said heel end of said midsole insert.

13. A reversible shoe as claimed in claim 9, wherein said top closure comprises hook and loop fasteners attached to said uppers.

14. A reversible shoe as claimed in claim 9, wherein said reversible uppers have a plurality of eyelets and wherein said top closure comprises a shoelace laced through said eyelets.

15. A reversible shoe as claimed in claim 9, wherein said uppers are positioned in said base between said top side and said bottom side.

16. A reversible shoe as claimed in claim 9, wherein said rear closure comprises a zipper.

17. A reversible shoe as claimed in claim 9, wherein said top side and said bottom side of said base have a tread.

18. A reversible shoe comprising:

a base having a top side, a bottom side, a toe end, and a heel end;

uppers secured to said base, said uppers being joined at said heel end by a rear closure;

a top closure for joining said uppers;

a removable midsole insert positioned between said uppers and removably connected to said base by a means for attaching the midsole insert to the base; said midsole insert having a toe end with a toe piece and a heel end with a heel support; and a tongue positioned between said uppers.

19. A reversible shoe as claimed in claim 18, further comprising:

a plurality of pegholes in said top side and said bottom side of said base, said plurality of pegholes partially penetrating said base; and a plurality of pegs capable of being inserted in said plurality of pegholes and projecting from said midsole insert.

20. A reversible shoe as claimed in claim 19, wherein said plurality of pegholes are located in said toe end and said heel end of said base and wherein said plurality of pegs projecting from said midsole insert project from said toe end and said heel end of said midsole insert.

21. A reversible shoe as claimed in claim 18, wherein said top closure comprises hook and loop fasteners attached to said uppers.

22. A reversible shoe as claimed in claim 18, wherein said reversible uppers have a plurality of eyelets and wherein said top closure comprises a shoelace laced through said eyelets.

23. A reversible shoe as claimed in claim 18, wherein said uppers are fused in said base between said top side and said bottom side.

24. A reversible shoe as claimed in claim 18, wherein said rear closure comprises a zipper.

25. A reversible shoe as claimed in claim 18, wherein said top side and said bottom side of said base have a tread.

* * * * *